United States Patent [19]

Weible et al.

[11] Patent Number: 5,001,948

[45] **Date of Patent: * Mar. 26, 1991**

[54] SCREWDRIVER BLADE WITH CURVED TIP

[75] Inventors: Warren W. Weible, Defiance; Steven C. Simpson, Napoleon, both of Ohio

[73] Assignee: SK Hand Tool Corporation, Defiance, Ohio

[ * ] Notice: The portion of the term of this patent subsequent to Nov. 7, 2006 has been disclaimed.

[21] Appl. No.: 430,426

[22] Filed: Nov. 2, 1989

[51] Int. Cl.[5] ..... B25B 13/48

[52] U.S. Cl. ..... 81/436; 81/438

[58] Field of Search ..... 81/436, 460, 438

[56] References Cited

U.S. PATENT DOCUMENTS 4,878,406 11/1989 Simpson et al. ..... 81/436

FOREIGN PATENT DOCUMENTS 87 of 1890 United Kingdom ..... 81/436

395165 7/1933 United Kingdom ..... 81/436

*Primary Examiner*—James G. Smith

*Attorney, Agent, or Firm*—Allen D. Gutchess, Jr.

[57] ABSTRACT

A stronger screwdriver blade is disclosed which is particularly effective for driving round-headed screws. The screwdriver blade has an elongate shank with a tapered end extending from the shank and terminating in a tip. The tip has a straight edge perpendicular to the shank and has a predetermined length and thickness, with side edges extending back toward the shank from ends of the end edge. The tip has substantially parallel, planar sides extending back toward the shank from the end edge to inner edges which, at the side edges, are spaced a distance from the end edge which is approximately equal to the thickness of the end edge. The inner edges are curved with the planar sides being from one and one-half to three and one-half times as wide at central portions as at end portions. From the inner edges, opposite side surfaces of the tapered end extend abruptly outwardly in a direction toward the shank so that the blade tip is thicker at high stress areas thereof.

18 Claims, 1 Drawing Sheet

SCREWDRIVER BLADE WITH CURVED TIP

This invention relates to a screwdriver blade, particularly for round-headed screws, which has greater resistance to failure.

In a co-pending application, U.S. Ser. No. 250,166, filed Sept. 28, 1988, a screwdriver blade is disclosed which is designed to fit and drive conventional screws with straight slots. This blade was substantially stronger than conventional screwdriver blades. It had been discovered through computer analyses that the greatest stress in screwdriver blades occurred at side edges of the blade tip at a predetermined distance back from the end edge of the tip. Screwdriver blades failed because of twisting and bending which occurred at those high-stress areas. Accordingly, the screwdriver blade was designed to be thicker and stronger in the areas of greatest stress. To achieve this, the screwdriver blade had a shank with a tapered end which terminated in a tip having a straight edge perpendicular to the shank. The straight tip edge was of predetermined thickness and the tip had parallel, planar sides extending back from this edge to straight inner edges which were parallel with the tip edge and spaced a distance therefrom which was approximately equal to the thickness of the tip edge. At the inner edges, opposite surfaces of the blade tip then extended rather abruptly outwardly from one another in a direction toward the shank at an angle of approximately fifteen degrees to an axis of the blade. Those opposite surfaces extended outwardly for a minimum distance of 0.2 inch from the tip edge toward the shank so as to be sure to extend beyond the areas of highest stress. The side edges of the tip also tapered outwardly toward the shank, each at approximately four degrees to the axis of the blade, for a minimum distance of 0.2 inch from the tip edge.

In accordance with the invention, it has been found that with the parallel, planar sides of the tip extending back from the tip edge to inner edges a distance approximately equal to the thickness of the tip edge, that the screwdriver blade would sometimes not properly engage round-headed screws. Rather, the depths of the round-headed screw slots, at their centers, would exceed the distance from the inner edges of the parallel, planar surfaces to the straight edge of the tip of the screwdriver blade. Consequently, the opposite side surfaces of the blade which extend rather abruptly outwardly from one another in a direction toward the shank would engage the central part of the round-screw head. This would prevent the screwdriver blade from being fully inserted into the screw slot and would also tend to cam the screwdriver blade out of the slot when the blade was turned under force to drive the screw. If the parallel, planar sides of the tip were widened so as to substantially exceed the thickness of the tip edge and the depth of the slot of the round-headed screw, the camming problem could be overcome. However, the thickness of the blade at the high-stress areas would not exceed or would not sufficiently exceed the thickness of conventional blades at those areas to cause the strength of the blade to be any higher or at least significantly higher than the strength of conventional blades.

The screwdriver blade in accordance with the invention is substantially stronger and is significantly higher in resistance to failure than conventional screwdriver blades and yet can accommodate round-headed screws and the like without causing the blade to cam out of the screw slot when turning force is applied to the screwdriver blade. To accomplish this, the new screwdriver blade has a shank with a tapered end which terminates in a tip having a straight edge perpendicular to the shank, as before. The straight edge is of predetermined thickness and the tip has parallel, planar sides extending back from the tip edge to inner edges for a distance approximately equal to the thickness of the tip edge, but only along the side edges of the blade tip. The inner edges of the parallel, planar sides are curved so that the central portions of the planar sides are wider than the ends of the planar sides at the side edges of the blade tip. With the curved inner edges, the central portions of the planar sides can be about twice the width of the planar sides at the side edges of the blade, with the center of curvature of the curved inner edges being beyond the straight edge of the tip. The new screwdriver blade is as thick at the side edges of the blade as before so that the blade is as thick at the areas of greatest stress. However, the planar sides are sufficiently wide at the central portions of the blade to accommodate the round-headed screws or the like without causing the blade to cam out of the screw slots.

It is, therefore, a principal object of the invention to provide an improved screwdriver blade, particularly for round-headed screws, having greater resistance to failure.

Another object of the invention is to provide a screwdriver blade which is stronger and yet will not tend to cause the screwdriver blade to cam out of a round-headed screw or similar screw when the screw is being turned by the blade.

Other objects and advantages of the invention will be apparent from the following detailed description of preferred embodiments thereof, reference being made to the accompanying drawings, in which.

Figure 1:
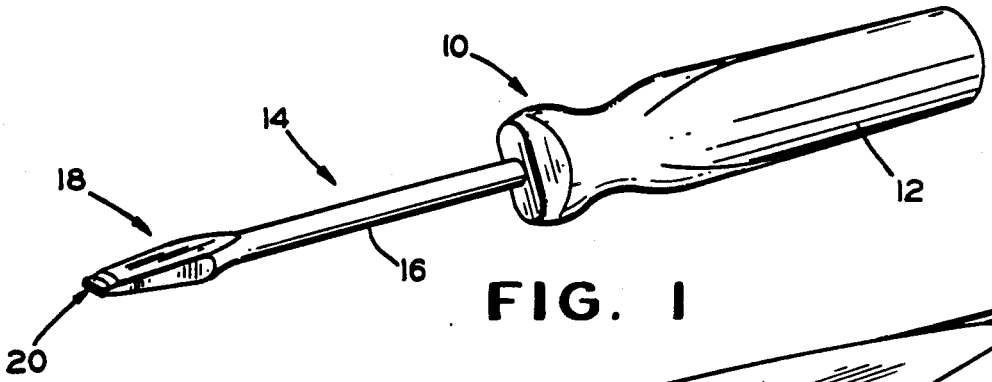
FIG. 1 is a view in perspective of a screwdriver incorporating a new screwdriver blade.
Figure 2:
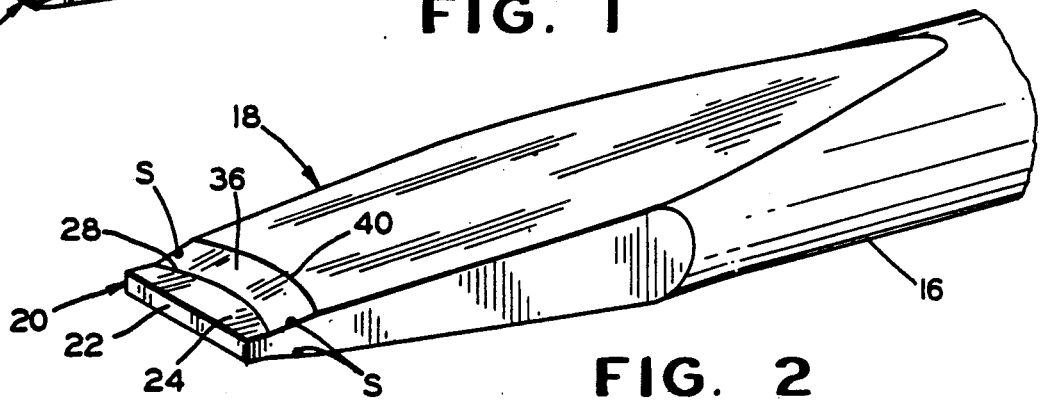
FIG. 2 is an enlarged, fragmentary view in perspective of the screwdriver blade.
Figure 3:
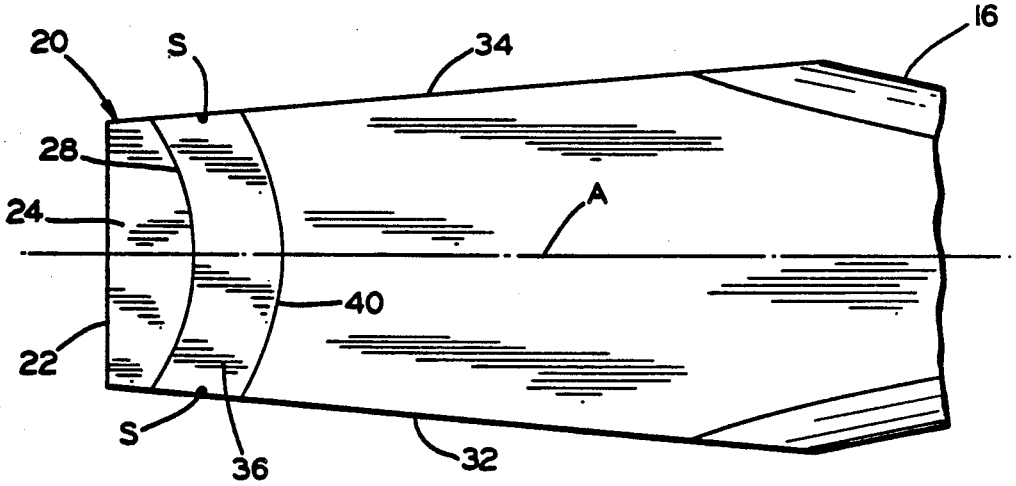
FIG. 3 is a further enlarged, fragmentary, plan view of the new screwdriver blade.
Figure 4:
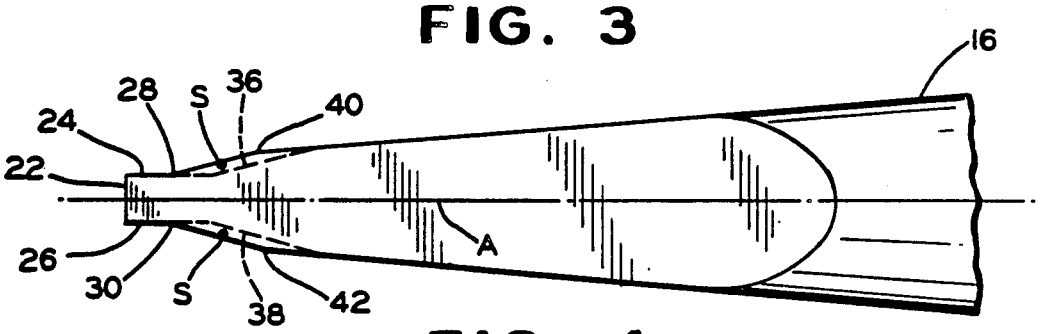
FIG. 4 is a fragmentary, side view of the new screwdriver blade.

Referring to the drawings and particularly to FIG. 1, a screwdriver embodying the invention is indicated at 10 and includes a handle 12 and a blade 14. The blade 14 has an elongate shank 16 and a tapered end 18 terminating in a tip 20. These are symmetrical both vertically and horizontally with respect to a longitudinal axis A (FIGS. 3 and 4).

The tip 20 has a straight end edge 22 which is perpendicular to the axis A and is of a predetermined thickness and length. The tip 20 further has parallel, planar sides 24 and 26 extending back toward the shank 16 from the end edge 22 to curved inner edges 28 and 30. Ends of the curved inner edges 28 and 30, at side edges 32 and 34 of the blade tip 20, are at a distance from the end edge 22 which is approximately equal to the thickness of the edge 22. Central portions of the curved inner edges 28 and 30 are at a greater distance from the end edge 22, with this distance being about twice the distance that the ends of the curved inner edges 28 and 30 are from the end edge 22.

From the curved inner edges 28 and 30, opposite surfaces 36 and 38 extend outwardly rather abruptly toward the shank 16. The surfaces 36 and 38 each form an angle of ten to twenty degrees, preferably approximately fifteen degrees, with respect to the axis A, as viewed in FIG. 4. As shown in FIG. 4, the surfaces 36 and 38 form the same angle until they end at further inner edges 40 and 42. However, it is only important that the angle be maintained for a distance of 0.2 inch from the straight end edge 22, which is beyond points or areas of highest stress in the blade end 18. The angle from there back toward the shank 16 is not critical since it is toward the handle from the stress points or areas on the end 18. The highest stress points or areas are designated with the letter S, these being along the side edges 32 and 34 of the end 18 and are at predetermined distances from the straight end edge 22 for any given size of blade.

As set forth above, the ends of the curved inner edges 28 and 30 are spaced from the end edge 22 a distance approximately equal to the thickness of the end edge 22. The width of the parallel sides 24 and 26, at the ends thereof, is also approximately equal to the thickness of the edge 22, of course. Thus, with a quarter-inch screwdriver (in which the length of the edge 22 is 0.250 inch) the thickness of the edge 22 is 0.043 inch and the width of the ends of the parallel sides 24 and 26 (the distance they extend back from the edge 22 to the inner edges 28 and 30) is 0.045 inch. With a five-sixteenths inch screwdriver blade, the thickness of the edge 22 is 0.053 inch and the width of the ends of the parallel sides 24 and 26 is 0.050 inch. With a three-eighths inch screwdriver blade, the thickness of the edge 22 is 0.055 inch and the width of the ends of the parallel sides 24 and 26 is 0.060 inch. For a seven-sixteenths inch screwdriver blade, the thickness of the edge 22 is 0.080 inch and the width of the ends of the parallel sides 24 and 26 is 0.078 inch.

As used herein, the term "approximately equal" means that the distance the ends of the curved inner edges 28 and 30 extend back from the end edge 22 and the width of the ends of the parallel sides 24 and 26 are within plus or minus ten percent of the thickness of the end edge 22.

The width of the parallel sides 24 and 26 at central portions thereof should be sufficient to be greater than the maximum depth of the slot of the largest round-headed screw with which the screwdriver is normally used. The maximum width of the sides 24 and 26 preferably is about twice the width at the ends, but can vary from one and one-half to three and one-half times the width at the ends. With a three-eighths inch screwdriver blade, for example, the width at the ends of the parallel sides 24 and 26 is 0.060 inch and the maximum width at the central portion of the sides is 0.125 inch. In most instances, the centers of curvature of the curved inner edges 28 and 30 lie on the axis A beyond the end edge 22 of the blade.

From the above, it will be seen that the curved inner edges 28 and 30 along with the parallel sides 24 and 26 being wider at central portions than at end portions, enable the side surfaces 36 and 38 to provide substantial thickness for the blade tip 18 at the stress points S, which thickness is substantially greater than that of conventional screwdriver blade tips. Failure of the new screwdriver blades due to twisting and bending which occurs at the high stress areas is substantially less than the failure of conventional screwdriver blades. At the same time, the curved design enables the new screwdriver blade to drive round-headed screws with the screw slots fully engaged by the parallel sides 24 and 26 without causing the blade to cam out of the screw head.

Each of the side edges 32 and 34 of the blade tip is planar and extends back at least 0.2 inch from the end edge 22 at an angle of approximately four degrees with the axis A, as viewed in FIG. 3. Beyond that point, the angles which the edges 32 and 24 make with the axis A are not as important.

Figure 5:
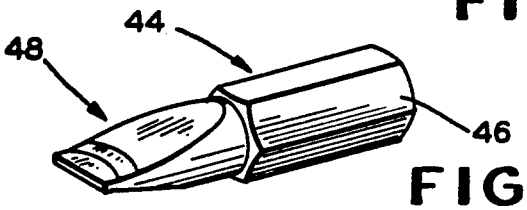
FIG. 5 is a view in perspective of the new screwdriver blade incorporating a different shank.

Referring to FIG. 5, a modified screwdriver blade 44 has a shank 46 and a tapered end 48, the shape of which is the same as that of the tapered end 18 of the blade 14. The shank 46 is in the form of a bit which is non-circular in transverse cross section and is designed to fit in a corresponding recess of a chuck of a driving tool.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A screwdriver blade comprising an elongate shank, a tapered end extending from said shank and terminating in a tip, said tip having a straight end edge perpendicular to said shank and having a predetermined length and thickness, said tip having side edges extending back toward said shank from ends of said end edge, said tip having substantially parallel, planar sides extending back toward said shank from said end edge to inner edges a minimum distance along said side edges which is approximately equal to the thickness of said end edge, said inner edges being curved with a center of curvature being beyond said end edge of said tip, opposite side surfaces of said tapered end extending abruptly outwardly from one another in a direction toward said shank from said inner edges of said planar sides.

2. A screwdriver blade according to claim 1 wherein said opposite side surfaces form angles of ten degrees to twenty degrees with respect to a longitudinal axis of said screwdriver blade.

3. A screwdriver blade according to claim 1 wherein said opposite side surfaces form angles of approximately fifteen degrees with respect to a longitudinal axis of said screwdriver blade.

4. A screwdriver blade according to claim 1 wherein said side edges of said tip extend outwardly from one another in a direction toward said shank from said straight end edge at angles of approximately four degrees with respect to the longitudinal axis of said screwdriver blade.

5. A screwdriver blade according to claim 1 wherein said opposite side surfaces extend abruptly outwardly from said inner edges for a minimum distance of 0.2 inch from said straight end edge.

6. A screwdriver blade according to claim 1 wherein said opposite side surfaces extend abruptly outwardly from said inner edges beyond maximum stress areas of the tapered end.

7. A screwdriver blade comprising an elongate shank, a tapered end extending from said shank and terminating in a tip, said tip having a straight end edge perpendicular to said shank and having a predetermined length and thickness, said tip having side edges extending back toward said shank from ends of said straight end edge, said tip having substantially parallel, planar sides extending back toward said shank from said end edge to curved inner edges, opposite side surfaces of said tapered end then extending abruptly outwardly from one another in a direction toward said shank from said curved inner edges with said opposite side surfaces along said side edges extending beyond maximum stress areas of said tapered end located along said side edges.

8. A screwdriver blade according to claim 7 wherein said inner edges at said side edges are less than 0.2 inch from said straight end edge.

9. A screwdriver blade according to claim 7 wherein said side surfaces extend abruptly outwardly at angles of ten degrees to twenty degrees with respect to a longitudinal axis of said screwdriver blade.

10. A screwdriver blade according to claim 7 wherein said opposite side surfaces form angles of approximately fifteen degrees with respect to a longitudinal axis of said screwdriver blade.

11. A screwdriver blade comprising an elongate shank, a tapered end extending from said shank and terminating in a tip, said tip having a straight end edge perpendicular to said shank and having a predetermined length and thickness, said tip having substantially parallel, planar sides extending back toward said shank from said end edge to curved inner edges, with the width of central portions of said planar sides being from one and one-half to three and one-half times the width at end portions thereof, opposite side surfaces of said tapered end then extending abruptly outwardly from one another in a direction toward said shank from said curved inner edges of said planar sides.

12. A screwdriver blade according to claim 11 wherein said opposite side surfaces form angles of ten degrees to twenty degrees with respect to a longitudinal axis of said screwdriver blade.

13. A screwdriver blade according to claim 11 wherein said opposite side surfaces form angles of approximately fifteen degrees with respect to a longitudinal axis of said screwdriver blade.

14. A screwdriver blade according to claim 11 wherein said tip has side edges extending back toward said shank from ends of said end edge, ends of said curved inner edges at said side edges being at a distance from said straight end edge approximately equal to the thickness of said straight end edge.

15. A screwdriver blade according to claim 11 wherein said opposite side surfaces extend abruptly outwardly for a minimum distance of 0.2 inch from said straight edge.

16. A screwdriver blade according to claim 11 wherein said opposite side surfaces extend abruptly outwardly from said inner edges beyond maximum stress areas of the tapered end.

17. A screwdriver blade according to claim 11 wherein central portions of said planar sides are approximately twice as wide as end portions thereof.

18. A screwdriver blade according to claim 11 wherein centers of curvature of said curved inner edges are beyond said end edge of said tip.

* * * * *